US006289982B1

(12) United States Patent
Naji

(10) Patent No.: US 6,289,982 B1
(45) Date of Patent: Sep. 18, 2001

(54) HEAT EXCHANGER, HEATING AND/OR AIR CONDITIONING APPARATUS AND VEHICLE INCLUDING SUCH A HEAT EXCHANGER

(75) Inventor: Said Naji, Elancourt (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/474,487

(22) Filed: Dec. 29, 1999

(30) Foreign Application Priority Data

Dec. 30, 1998 (FR) ..... 98 16638

(51) Int. Cl.[7] ..... F28F 1/40; F28D 1/03
(52) U.S. Cl. ..... 165/177; 165/153; 165/179
(58) Field of Search ..... 165/153, 177, 165/179

(56) References Cited

U.S. PATENT DOCUMENTS 4,330,036 * 5/1982 Satoh et al. ..... 165/179
4,470,452 9/1984 Rhodes ..... 165/153
5,111,878 5/1992 Kadle .
5,538,077 * 7/1996 So et al. ..... 165/153 X
5,918,664 * 7/1999 Torigoe ..... 165/153 X

FOREIGN PATENT DOCUMENTS

3313422 * 10/1984 (DE) ..... 165/177
0 206 836 12/1986 (EP) .
2 276 937 10/1994 (GB) .
58 140597 8/1983 (JP) .
6-221789 * 8/1994 (JP) ..... 165/153

* cited by examiner

*Primary Examiner*—Leonard Leo
(74) *Attorney, Agent, or Firm*—Morgan & Finnegan, LLP

(57) ABSTRACT

A heat exchanger, particularly an evaporator, has a number of ducts (19) for the flow of a cooling fluid which are connected in series, each duct (19) being produced as a pair of plates (13) including a concave region (3) limited by an edge (5) and provided with a number of studs forming dimples (9), the dimples being randomly distributed. The invention applies mainly to the air conditioning of motor vehicles.

10 Claims, 2 Drawing Sheets

HEAT EXCHANGER, HEATING AND/OR AIR CONDITIONING APPARATUS AND VEHICLE INCLUDING SUCH A HEAT EXCHANGER

FIELD OF THE INVENTION

The present invention relates to a heat exchanger, and more particularly to an evaporator for a heating and/or air conditioning apparatus, suitable for motor vehicles, to a heating and/or air conditioning apparatus including such an evaporator and to a motor vehicle including such an apparatus.

BACKGROUND OF THE INVENTION

It is usual to produce evaporators or heat exchangers, exchanging heat between a cooling fluid and air, as a stack of plates, virtually identical for preference, positioned symmetrically in pairs. A pair of plates arranged opposite each other forms a substantially U-shaped duct whose inlet is connected to the outlet of the U-shaped duct of the preceding pair of plates (if there are any, that is to say if it is not the first pair of plates), and whose outlet is connected to the inlet of the U-shaped duct formed by the next pair of plates (if there are any, that is if it is not the last pair of plates). Cooling air flows between the consecutive pairs of plates. It is known for stamped dimples to be formed on at least one of the pairs of plates forming a duct. These dimples are identical in shape, position and orientation. They project into the interior of the duct formed by the pairs of plates and thus allow better heat exchange by agitating the cooling fluid flow, and especially by promoting its movement in a turbulent flow. These dimples can be formed by an assembly method, particularly by brazing two bosses opposite each other. In this case, the plates forming a pair of plates are the same as one another, and each boss has an equivalent height of half the depth of the U-shaped duct, that is to say of the distance from the opposing plates.

Moreover, the dimples can be formed by brazing the bosses of a first plate against the flat surface of a second plate. In this case, the two plates of a pair of plates can be identical and each dimple has a height equal to the depth of the U-shaped ducts.

Unfortunately the flow of cooling fluid in this known type of evaporator produces a noise, particularly a whistling, which is extremely unpleasant for the vehicle occupants, and vibrations detrimental to the longevity of the evaporator. The amplitude of the radiated noise is accentuated by the geometry of the evaporator including an overlaying of the sets of plates.

OBJECTS OF THE INVENTION

As a consequence it is one aim of the invention to provide a heat exchanger particularly for a heating and/or air conditioning device for motor vehicles which allows a flow of cooling fluid minimizing the generation of the noise and/or vibration liable to annoy the occupants of a motor vehicle.

It is equally an aim of the invention to offer a heat exchanger of great solidity, and especially with a very good resistance to the internal pressure of the cooling fluid.

It is also an aim of the present invention to offer such a heat exchanger giving excellent thermodynamic effectiveness.

It is equally an aim of the invention to offer a heat exchanger with a long life.

The applicant has noted that the whistling caused by the known type of evaporator originates from the regular distribution of the dimples. A gas passing at a given speed through an aperture of specific cross-section emits a very shrill noise around a particular frequency (Strouhal effect). Thus, the fact that the dimples are of identical shape and orientation, and are equidistant, creates an overlay of sound of the same frequency, hence an acoustic discomfort. An effect of the present invention is to diversify the frequencies emitted while the fluid is flowing, so that the noise emitted (overlay of sounds at different frequencies) may be more neutral.

SUMMARY OF THE INVENTION

According to the a first aspect of the present invention there is provided a heat exchanger including a number of ducts for the flow of a cooling fluid, which are connected in series, each duct being produced as a pair of plates comprising a concave region delimited by an edge and provided with a number of bosses forming dimples wherein a random distribution of the dimples is used.

An embodiment of the present invention relates to a plate evaporator including dimples distributed randomly, that is to say dimples distributed in a random way over the surface of the duct formed between two consecutive plates of one pair of plates and/or by the shape of the dimples.

Advantageously, these obstacles are arranged symmetrically in relation to an axis passing halfway between the two branches of the U. Thus, a U-shaped duct can be formed by assembling two identical plates, turned over in relationship to each other, with their concave faces placed facing each other.

The invention relates to a heat exchanger including a number of ducts for the flow of a cooling fluid which are connected in series, each duct being produced as a pair of plates including a concave region delimited by one edge and provided with a number of bosses forming dimples, characterized by the use of a random distribution of the dimples.

The dimples can have a cylindrical or substantially cylindrical shape. Each dimple can have a shape chosen at random from a set of different shapes of dimple.

BRIEF DESCRIPTION OF THE DRAWINGS

The invention will be better understood by means of the following description and of the annexed figures, given as non-limiting examples, and in which.

DESCRIPTION OF THE PREFERRED EMBODIMENT

Figure 2:
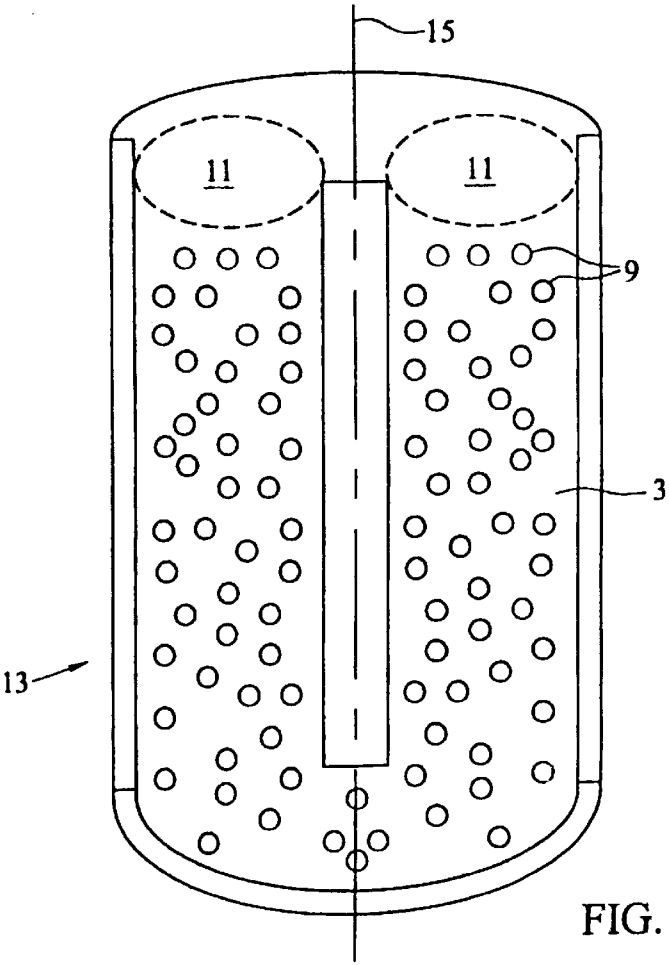
FIG. 2 is a plan view of a first embodiment of an evaporator plate according to the present invention.
Figure 1:
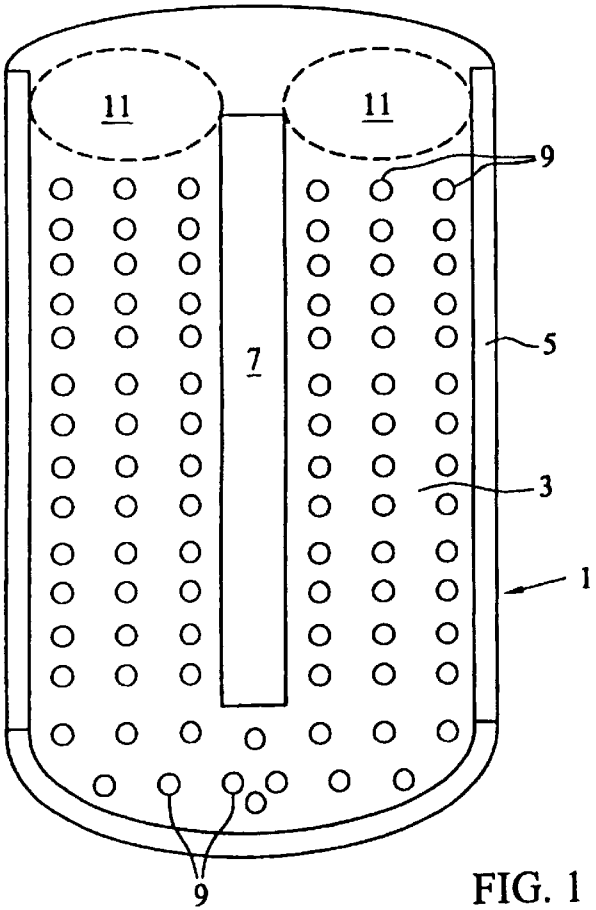
FIG. 1 PRIOR ART
FIG. 1 is a plan view of a known type of plate.
Figure 3:
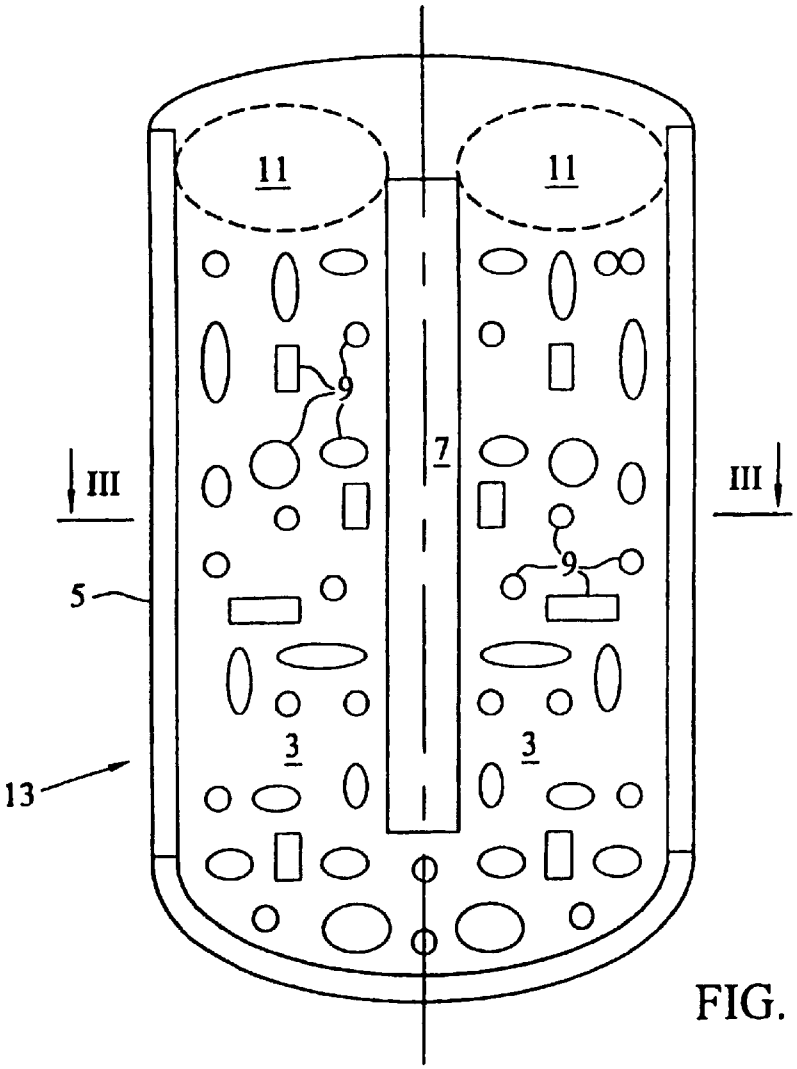
FIG. 3 is a plan view of a second embodiment of an evaporator according to the present invention.

In FIGS. 1 to 3, the same references are used to designate the same elements.

In FIG. 1 can be seen a known type of plate, in which the face-to-face pairwise assembly makes it possible to form a U-shaped duct, the set of ducts forming an evaporator for a device for heating and/or air conditioning a motor vehicle. The plate 1 is produced by stamping and includes a U-shaped concave region 3 intended to form a duct for cooling fluid and an edge 5, a central rib 7 separating the two branches into a U shape and dimples 9 projecting in relation to the region 3. The plate 1 further includes an aperture 11 or two regions 11 capable, after cutting out, of forming an aperture 11 making it possible to form an inlet or an outlet of a U-shaped duct formed by two assembled plates.

The dimples are identical in shape, surface area and orientation. In the example shown in FIG. 1, the dimples 9 of plate 1 have a shape which is virtually cylindrical and are regularly distributed over three columns in each of the two branches of the U. Each column comprises 14 rows; furthermore, dimples 9 are regularly distributed in the base of the U joining these two branches.

The regular distribution in row and in column of the dimples 9 on the plate 1, and as a result in the U-shaped duct of the evaporator, aids the generation of noise and vibration while the cooling fluid is flowing in the evaporator.

In FIG. 2 can be seen a first embodiment of a plate 13 for an evaporator which differs from the plate 1 in FIG. 1 solely by a random distribution of the similar dimples 9, which are cylindrical or substantially cylindrical, over the surface area of the U-shaped duct 3. Advantageously, the plates 1 and 13 on average carry the same density of dimples 9 per unit of surface area of the concave region 3. Advantageously, the dimples 9 are distributed symmetrically with respect to a plane of symmetry 15 of the plate 13 passing through the middle of the rib 7 and crossing the base of the U. Thus two identical plates 13 can be used to produce each U-shaped duct of the evaporator, advantageously produced by stamping, by arranging opposite each other the concave feature 3 forming the U-shaped duct. The projecting elements, such as edges 5, rib 7 and dimples 9 are covered with a hot-melt coating, then the assembly is placed in an oven allowing assembly by brazing.

The random arrangement of the dimples 9 does not change the thermodynamic characteristics of the exchanger according to the present invention given that the dimples 9 disturb the flow of the cooling fluid. On the contrary, the lack of regularity in the distribution of the dimples 9 makes it possible to distribute the acoustic energy originating from the flow over a wide spectrum, preventing the appearance of noise and of vibration of high amplitude and single frequency. Moreover, the random distribution of dimples allows better dispersion of the stresses set up by the cooling fluid on the internal walls of the U-shaped duct and thus makes it possible to improve its solidity and, as a result, the longevity of the evaporator according to the invention.

It is clear that the invention is not restricted to the use of identical dimples 9, but extends equally to the use of dimples of varied shapes. Dimples of varied shapes will be used, regularly distributed, for example in a similar manner to the distribution of the dimples 9 in FIG. 1. For example, dimples with a circular base (cylindrical dimples) of various diameters can be used, as well as dimples with elliptical oval, polygonal (regular or non-regular polygons), or other bases. The use of dimples 9 of varied shapes also allows the acoustic energy to be distributed over a wide frequency band, avoiding high-amplitude acoustic peaks.

In FIG. 3, however, the preferred example of plates 13 according to the present invention can be seen, similar to those of plate 13 in FIG. 2, but including dimples 9 of varied shapes distributed in random manner in the U-shaped concave region. In the example shown, cylindrical dimples 9 of various diameters are used, dimples in the shape of a rectangular parallelepiped of various lengths and orientations, and dimples with elliptical bases. It is clear that other shapes of dimples, for example dimples with a triangular or star-shaped base, of irregular shape or others do not depart from the context of the invention. Advantageously, the dimples 9 are distributed symmetrically with respect to a longitudinal plane of symmetry 15 passing through the middle of the rib 7 and perpendicular to the plate 13.

It is clear that the invention is not restricted to evaporators including U-shaped ducts but extends equally to plate evaporators including ducts with other geometries, as for example linear ducts.

The dimples 9 according to the invention have a height of less than 3 mm and a limited extension, for example of less than 9 centimeters, preferably than 5 centimeters, yet more preferably less than 3 centimeters, for example between 2 centimeters and 1 millimeter.

The plates 13 are made for example of aluminum or of aluminum alloy.

At least some of the dimples can have a random cross-sectional dimension or even a different cross-sectional dimension. The dimples can have an identical shape and a random orientation, or yet again an identical shape and a different orientation.

The surface area $S_o$ defined by the sum of the surface areas of each section of dimples is advantageously less than 20%, or even 10% of the total surface area S of the ducts. For preference, $S_o$ lies between 11.5% and 13% of S.

The evaporator 17 includes means of interconnection with a cooling fluid circuit, a heating apparatus, particularly of an additional thermodynamic heating for the passenger compartment of a motor vehicle and/or an air conditioning apparatus for this compartment. The evaporator 17 advantageously includes means, particularly fins, promoting thermal exchange with the cooling air.

Figure 4:
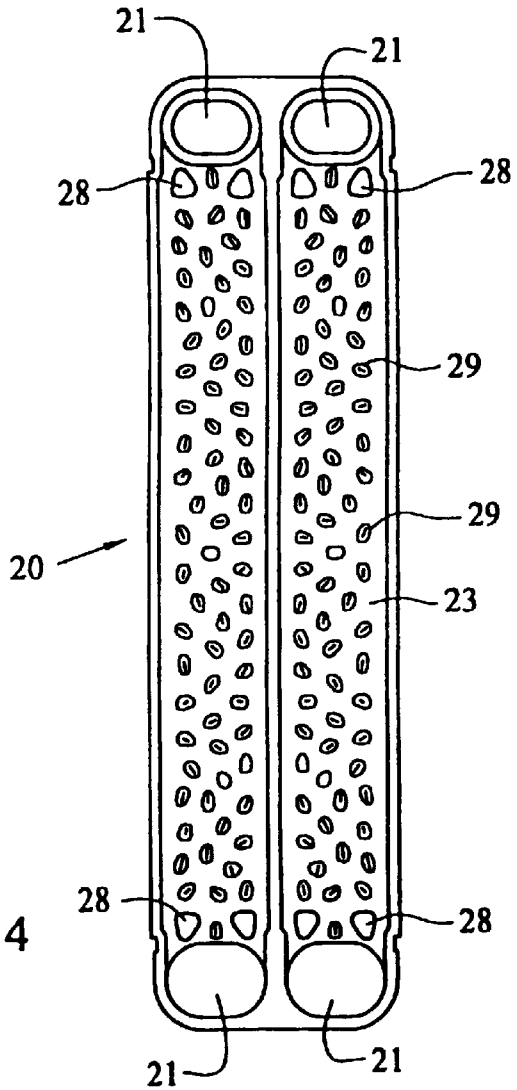
FIG. 4 is a plan view of a third embodiment of an evaporator according to the present invention.

FIG. 4 corresponds to a plate 20 of a dual-chamber, I-flow, evaporator, but the patterns represented can be applied to the plates of a single-chamber U-flow evaporator.

According to this embodiment, the exchanger has first dimples having an identical shape and a random orientation and, in the vicinity of at least one fluid inlet, second dimples of cross-section larger than that of the first dimples.

A plate 20 includes apertures 21 at its extremities for a supply of cooling fluid, and channels 23 for the fluid to flow from one end of the plates 20 to the other. Dimples 29 of elongate shape and substantially identical are distributed in such a way that their orientations are random. These dimples 29 have a cross-section for example of between 5 $mm^2$ and 15 $mm^2$ and preferably equal to 6 $mm^2$.

In the vicinity of the apertures 21, that is in a region of change of direction of flow, there are dimples 28, for example 2 in number, of larger dimensions than the dimples 29, for example of between 20 $mm^2$ and 35 $mm^2$ and preferably equal to 21 $mm^2$.

The present invention applies to all types of evaporator plate and particularly to plates with straight channels or plates with asymmetric apertures 11 (plate having an aperture 11 smaller at the inlet than at the outlet, for example).

The present invention applies particularly to the production of heat exchangers, of ducts and evaporators for a heating and/or air conditioning installation, for example including a sealed cooling-fluid circuit including a heat exchanger, particularly an evaporator.

The invention applies mainly to the automobile industry.

What is claimed is:

1. A heat exchanger including a number of ducts for the flow of a cooling fluid, which are connected in series, each duct being produced as a pair of plates comprising a concave region delimited by an edge and provided with a number of bosses forming dimples wherein a random distribution of the dimples is used and includes dimples each having a shape chosen randomly from a set of different shapes of dimple.

2. The heat exchanger of claim 1, wherein at least some of the dimples have a cross-section of random dimension.

3. The heat exchanger of claims 1, wherein at least some of the dimples have a cross-section of different dimension.

4. A heat exchanger including a number of ducts for the flow of a cooling fluid, which are connected in series, each duct being produced as a pair of plates comprising a concave region delimited by an edge and provided with a number of bosses forming dimples wherein a random distribution of the dimples is used and includes dimples each having a shape chosen randomly from a set of different shapes of dimple, and wherein the surface area defined by the sum of the surface areas of each cross- section of the dimples is less than 20% of the total surface area of the ducts.

5. The heat exchanger of claim 4, wherein the said sum of the surface areas is less than 10% of the total surface area of the ducts.

6. The heat exchanger of claim 4, wherein the said sum of the surface areas is between 11.5% and 13% of the total surface area of the ducts.

7. Air conditioning and/or heating system for a motor vehicle, which includes a sealed circuit for circulating a cooling fluid comprising a heat exchanger including a number of ducts for the flow of a cooling fluid, which are connected in series, each duct being produced as a pair of plates comprising a concave region delimited by an edge and provided with a number of bosses forming dimples wherein a random distribution of the dimples is used and includes dimples each having a shape chosen randomly from a set of different shapes of dimple.

8. The conditioning and/or heating system for a motor vehicle of claim 7, wherein the surface area defined by the sum of the surface areas of each cross-section of the dimples is less than 20% of the total surface area of the ducts.

9. Motor vehicle which includes an air conditioning system which includes a sealed circuit for circulating a cooling fluid comprising a heat exchanger including a number of ducts for the flow of a cooling fluid, which are connected in series, each duct being produced as a pair of plates comprising a concave region delimited by an edge and provided with a number of bosses forming dimples wherein a random distribution of the dimples is used and includes dimples each having a shape chosen randomly from a set of different shapes of dimple.

10. The motor vehicle of claim 9, wherein the surface area defined by the sum of the surface areas of each cross-section of the dimples is less than 20% of the total surface area of the ducts.

* * * * *